US008087356B2

(12) United States Patent
Gsell et al.

(10) Patent No.: US 8,087,356 B2
(45) Date of Patent: Jan. 3, 2012

(54) HANDLING DEVICE OF A PRINTING PRESS

(75) Inventors: Thomas Gsell, Dillingen (DE); Rudolf Stroh, Duernau (DE)

(73) Assignee: Man Roland Druckmaschinen AG, Augsburg (DE)

( * ) Notice: Subject to any disclaimer, the term of this patent is extended or adjusted under 35 U.S.C. 154(b) by 898 days.

(21) Appl. No.: 11/943,856

(22) Filed: Nov. 21, 2007

(65) Prior Publication Data

US 2008/0156213 A1 Jul. 3, 2008

(30) Foreign Application Priority Data

Nov. 22, 2006 (DE) ..... 10 2006 054 957

(51) Int. Cl.
*B41F 27/12* (2006.01)

(52) U.S. Cl. ..... 101/477; 101/382.1; 101/415.1

(58) Field of Classification Search ..... 101/116, 101/378, 382.1, 415.1, 477
See application file for complete search history.

(56) References Cited

U.S. PATENT DOCUMENTS

| | | | | |
|---|---|---|---|---|
| 4,727,807 | A | 3/1988 | Suzuki et al. | |
| 5,072,671 | A * | 12/1991 | Schneider et al. | 101/467 |
| 5,074,212 | A * | 12/1991 | Kobler et al. | 101/477 |
| 5,094,165 | A * | 3/1992 | Sugiyama et al. | 101/415.1 |
| 5,127,322 | A * | 7/1992 | Kobler | 101/219 |
| 5,211,112 | A * | 5/1993 | Tsushima et al. | 101/415.1 |
| 5,533,446 | A * | 7/1996 | Hashimura et al. | 101/150 |
| 6,951,172 | B2 * | 10/2005 | Detmers et al. | 101/480 |

FOREIGN PATENT DOCUMENTS

| | | | |
|---|---|---|---|
| DE | 103 38 374 | A1 | 3/2005 |
| DE | 10 2004 052 021 | A1 | 5/2006 |
| DE | 10 2004 037 253 | A1 | 9/2006 |
| EP | 0 431 364 | A2 | 6/1991 |
| JP | 01-1 27 347 | | 5/1989 |
| JP | 02-0 43 143 | | 2/1990 |
| WO | WO 2005/110754 | A1 | 11/2005 |

OTHER PUBLICATIONS

English translation of JP 01-127347, Yoshinori et al, May 1989.*
Pending U.S. Appl. No. 12/172,018, titled "Handling Device of a Printing Press", Inventors Gsell, et al., filed Jul. 11, 2008.
European Search Report.

* cited by examiner

*Primary Examiner* — Ren Yan
(74) *Attorney, Agent, or Firm* — Crowell & Moring LLP

(57) ABSTRACT

A handling device of a printing press, in particular for handling printing plates during an automated change of printing plates on a printing unit of a printing press, is disclosed. The handling device has a manipulator arm, where a manipulator head is allocated to one end of the manipulator arm, which head features a handling element, in particular a holding element for printing plates. The manipulator arm is of a multi-piece design of several segments, where a swivel axis is included on each end of each segment, around which axis at least the respective segment can be swiveled, and where a separate drive for providing the respective swivel motion is allocated to each swivel axis.

3 Claims, 4 Drawing Sheets

HANDLING DEVICE OF A PRINTING PRESS

This application claims the priority of German Patent Document No. 10 2006 054 957.0, filed Nov. 22, 2006, the disclosure of which is expressly incorporated by reference herein.

BACKGROUND AND SUMMARY OF THE INVENTION

The invention relates to a handling device of a printing press.

A handling device of a printing press embodied as a printing plate manipulator is known from German Patent Document No. DE 10 2004 052 021 A1. This device is used to handle printing plates during an automated change of printing plates on a printing unit of a printing press. The printing plate manipulator disclosed there is comprised of a manipulator arm with a manipulator head being positioned on one end of the manipulator arm so that it can pivot. The manipulator head features a holding element for printing plates. On the end of the manipulator arm that is opposite from the end on which the manipulator head is pivoted, the manipulator arm of the printing plate manipulator is displaceably positioned in a guide of a frame of a printing unit so that the entire manipulator arm can be moved up and down in a vertical direction. In addition, an articulation is allocated to this end of the manipulator arm so that it can continue to swivel.

Starting herefrom, the present invention is based on the objective of creating a novel handling device for a printing press.

According to the invention, the manipulator arm is embodied in a multi-piece manner of several segments, wherein a swivel axis is embodied on each end of each segment, around which axis at least the respective segment can be swiveled, and wherein a separate drive for providing the respective swivel motion is allocated to each swivel axis.

The handling device in accordance with the invention has a multi-piece manipulator arm, whereby a swivel axis is embodied on each end of each segment of the manipulator arm. A separate drive is allocated to each swivel axis. The handling device in accordance with the invention can be positioned and/or swiveled more flexibly and requires less space as compared with the handling device known from the prior art.

The manipulator arm preferably has a first segment to connect the manipulator arm to a frame and/or to a wall of the printing press, a second segment to connect the manipulator head to the manipulator arm and at least one third segment via which the first segment and the second segment are connected to each other. The end of the first segment, which is used to connect the manipulator arm to the frame and/or to the wall is embodied to be stationary in particular.

A swivel axis is embodied respectively on the end of the first segment, via which the manipulator arm is connected to the frame and/or to the wall of the printing press, as well as on the end of the second segment, via which the manipulator head is attached to the manipulator arm, as well as on the ends of the segments, at which the first segment and the second segment are connected to a third segment and, if applicable, third segments are connected among one another, wherein a drive is allocated respectively to each of these swivel axes.

Preferred developments of the invention are yielded from the following description. Without being limited hereto, exemplary embodiments of the invention are explained in greater detail on the basis of the drawings.

DETAILED DESCRIPTION OF THE DRAWINGS

Figure 1:
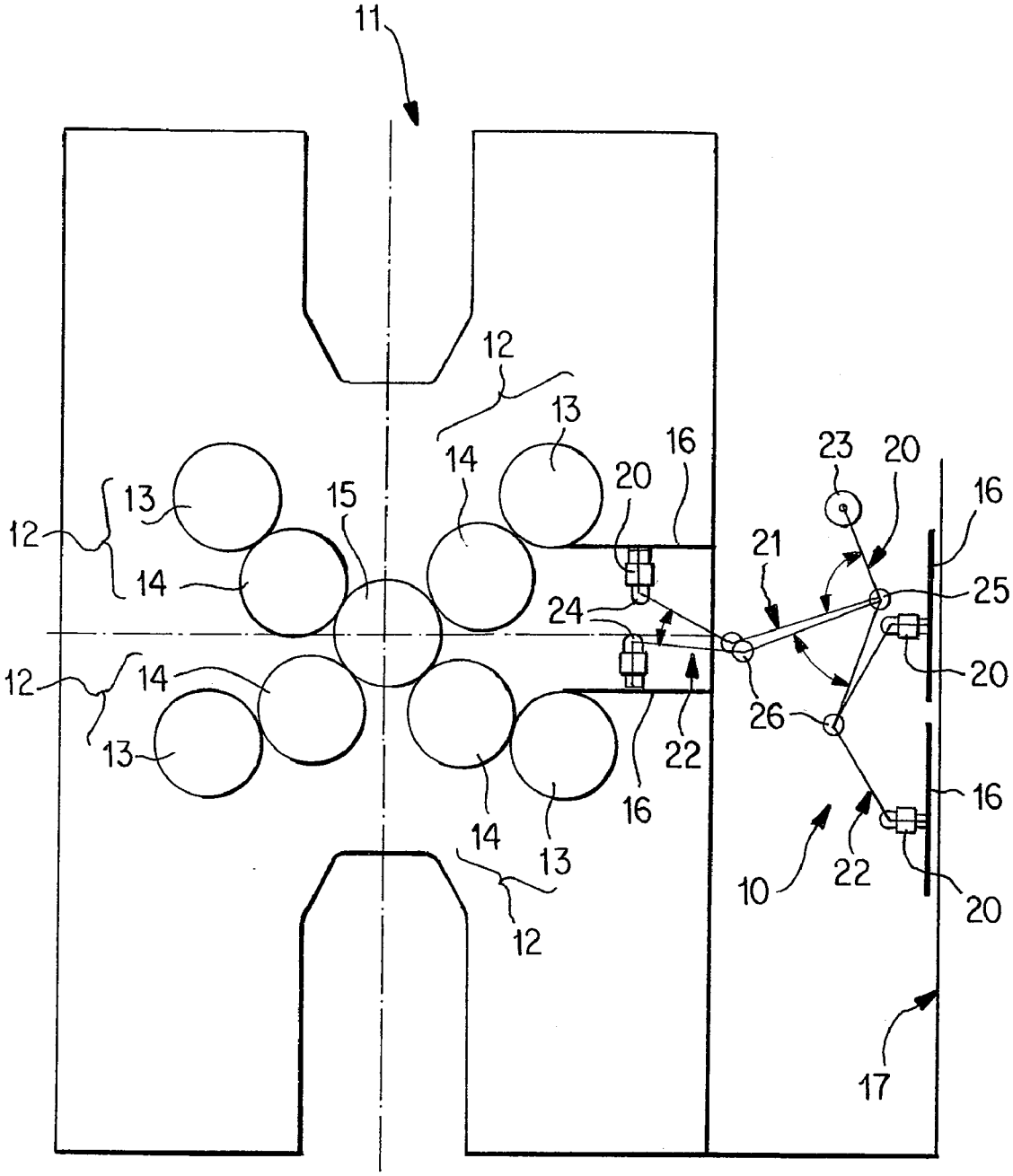
FIG. 1 is a schematic representation of a printing unit of a web-fed printing press together with a handling device in accordance with the invention.

FIG. 1 shows a schematic representation of an inventive handling device 10 of a printing press together with a printing unit 11 of a web-fed rotary press embodied as a satellite printing unit. The satellite printing unit in FIG. 1 has four printing couples 12, whereby only plate cylinders 13 as well as transfer cylinders 14 from each printing couple 12 are depicted. All transfer cylinders 14 of the printing couples 12 roll off one satellite cylinder 15.

In the exemplary embodiment shown, the inventive handling device 10 is used to handle printing plates 16 during an automatic or automated change of printing plates on the printing couples 12 of the printing unit 11. FIG. 1 depicts the handling device 10 in a total of four different positions in order to show that this device can be positioned flexibly in the space. In two of the positions depicted, the handling device 10 is grasping printing plates 16 that are ready to be supplied at a web guide wall 17. In the two other positions depicted, on the other hand, the handling device 10 is delivering the printing plates 16 to the plate cylinders 13 of printing couples 12.

Figure 2:
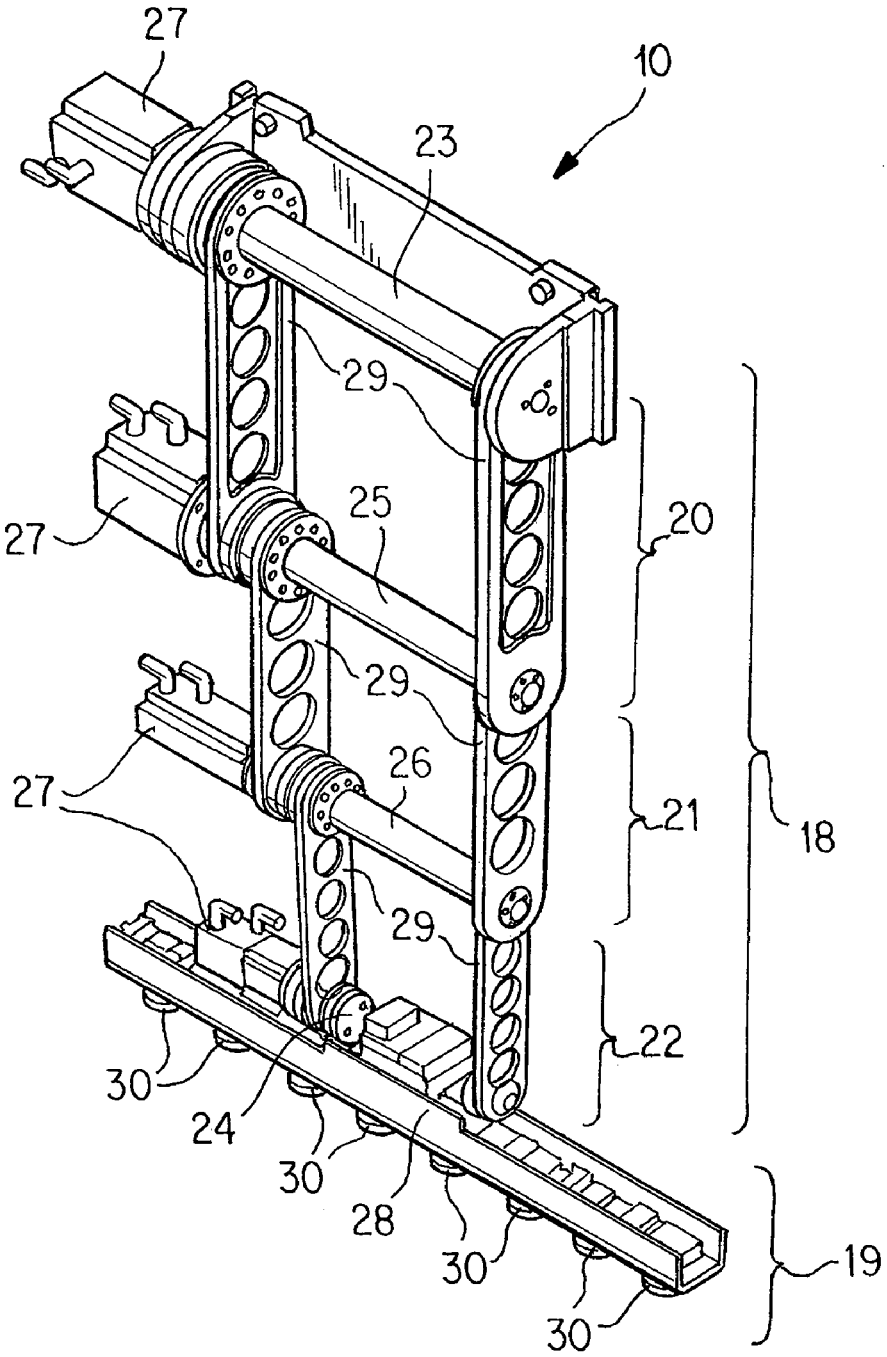
FIG. 2 is a perspective view of a schematic representation of an inventive handling device of a printing press.
Figure 4:
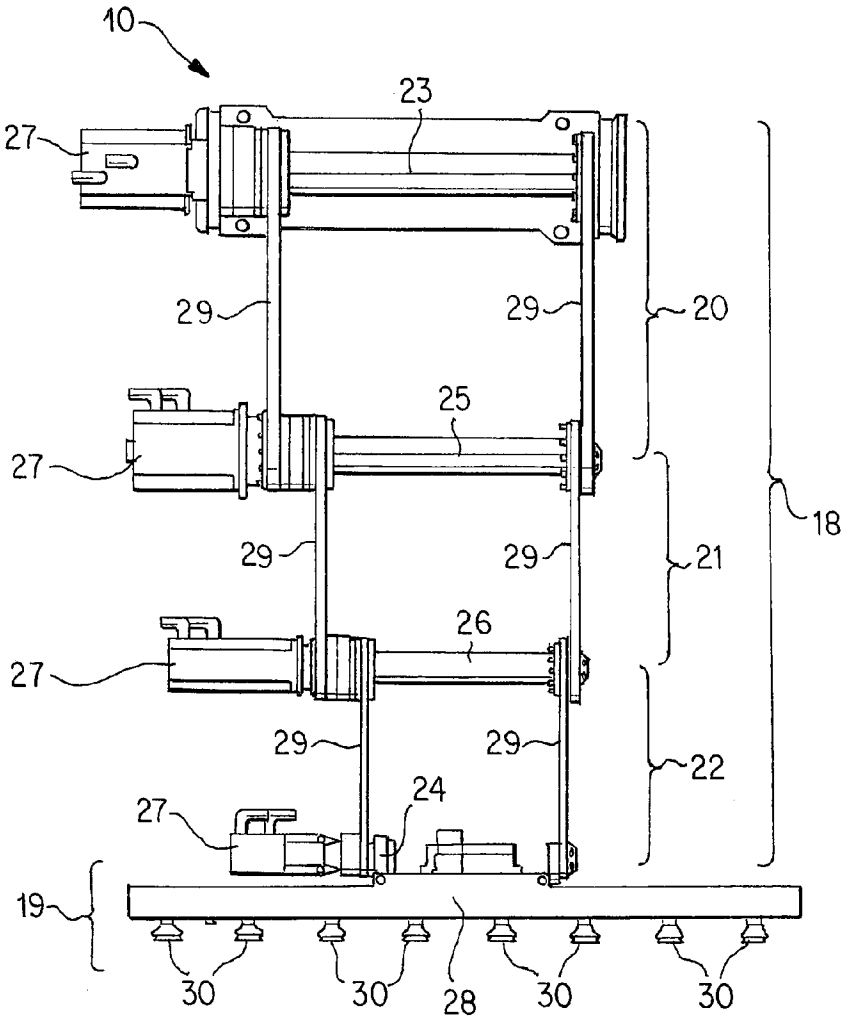
FIG. 4 is a front view of the handling device in FIG. 2.
Figure 3:
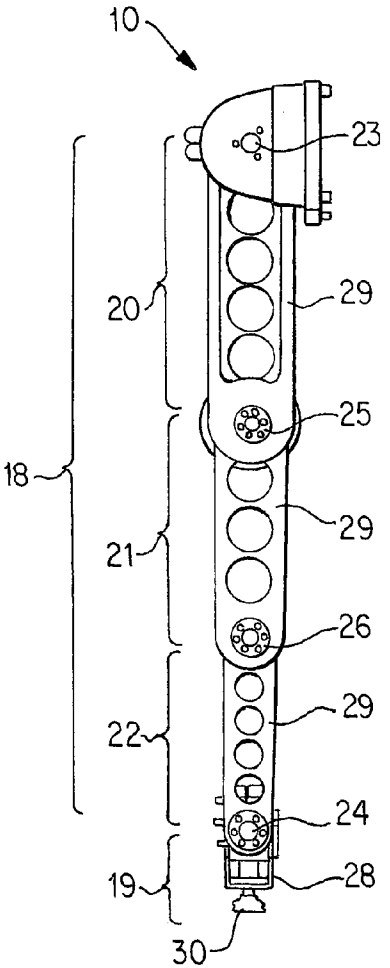
FIG. 3 is a side view of the handling device in FIG. 2.

FIGS. 2 through 4 show the inventive handling device 10 in greater detail. Thus, the handling device 10 is comprised of a manipulator arm 18 and a manipulator head 19, whereby the manipulator head 19 has a handling element 28.

According to the invention, the manipulator arm 18 is embodied in a multi-piece manner of several segments, whereby the manipulator arm 18 has three segments 20, 21 and 22 in the depicted exemplary embodiment. A first segment 20 is used to connect the manipulator arm 18 to a frame and/or to a wall of the printing press, a second segment 22 is used, on the other hand, to connect the manipulator head 19 to the manipulator arm 18. A third segment 21 is used to connect the first segment 20 to the second segment 22, whereby, in contrast to the depicted exemplary embodiment, several third segments can also be arranged between the first segment 20 and the second segment 22.

A swivel axis is embodied on each end of the segments 20, 21 and 22. Thus, a first swivel axis 23 is embodied on the end of the first segment 20, via which the manipulator arm 18 is connected to the frame and/or to the wall of the printing press. A second swivel axis 24 is embodied on the end of the second segment 22, which is used to connect the manipulator head 19 to the manipulator arm 18. Additional swivel axes 25 and 26 are embodied on the ends of the segments 20, 21 and 22, at which the first segment 20 is connected to the third segment 21 and the second segment 22 is connected to the third segment 21. The swivel axis 23, which is used to connect manipulator arm 18 to the frame and/or to the wall of the printing press, is preferably embodied to be stationary.

A separate drive 27 is allocated to each swivel axis 23, 24, 25 and 26 in order to guarantee the swivel motion of the segments 20, 21 and 22 relative to one another and/or the swivel motion of the manipulator head 19 relative to the second segment 22 of the manipulator arm 18 and/or the swivel motion of the first segment 20 of the manipulator arm 18 relative to the frame and/or to the wall of the printing press. The drives 27 are electromotive drives. The drives 27 can be used to individually swivel each segment 20, 21 and 22 of the manipulator arm 18 as well as the manipulator head 19.

In the depicted exemplary embodiment, each segment 20, 21 and 22 of the manipulator arm 18 is formed by two braces 29 that run parallel to each other. A swivel axis is allocated to each end of a brace 29 and therefore to each end of a segment 20, 21 and 22.

In the depicted exemplary embodiment, the handling element 28 is embodied as a suction device featuring several suction nozzles 30. Reference is made at this point to the fact that the handling element 28 can be embodied to be replaceable so that it is possible to replace, for example, a suction device for handling printing plates with a blanket wash-up device or another handling element. The handling element 28, which is embodied as a suction device in the depicted exemplary embodiment, extends over the entire axial extension of the plate cylinders 13 of the printing couples 12 of the printing unit 11.

As already stated, the handling element 28 in the depicted exemplary embodiment is embodied as a suction device featuring several suction nozzles 30. In this case, every two suction nozzles 30 are used to handle one printing plate 16 so that a total of four printing plates can be handled by the suction device depicted in FIGS. 2 through 4. Reference is made to the fact that the number of suction nozzles present is purely exemplary and will depend upon the number of printing plates to be handled by each plate cylinder.

Figure 5:
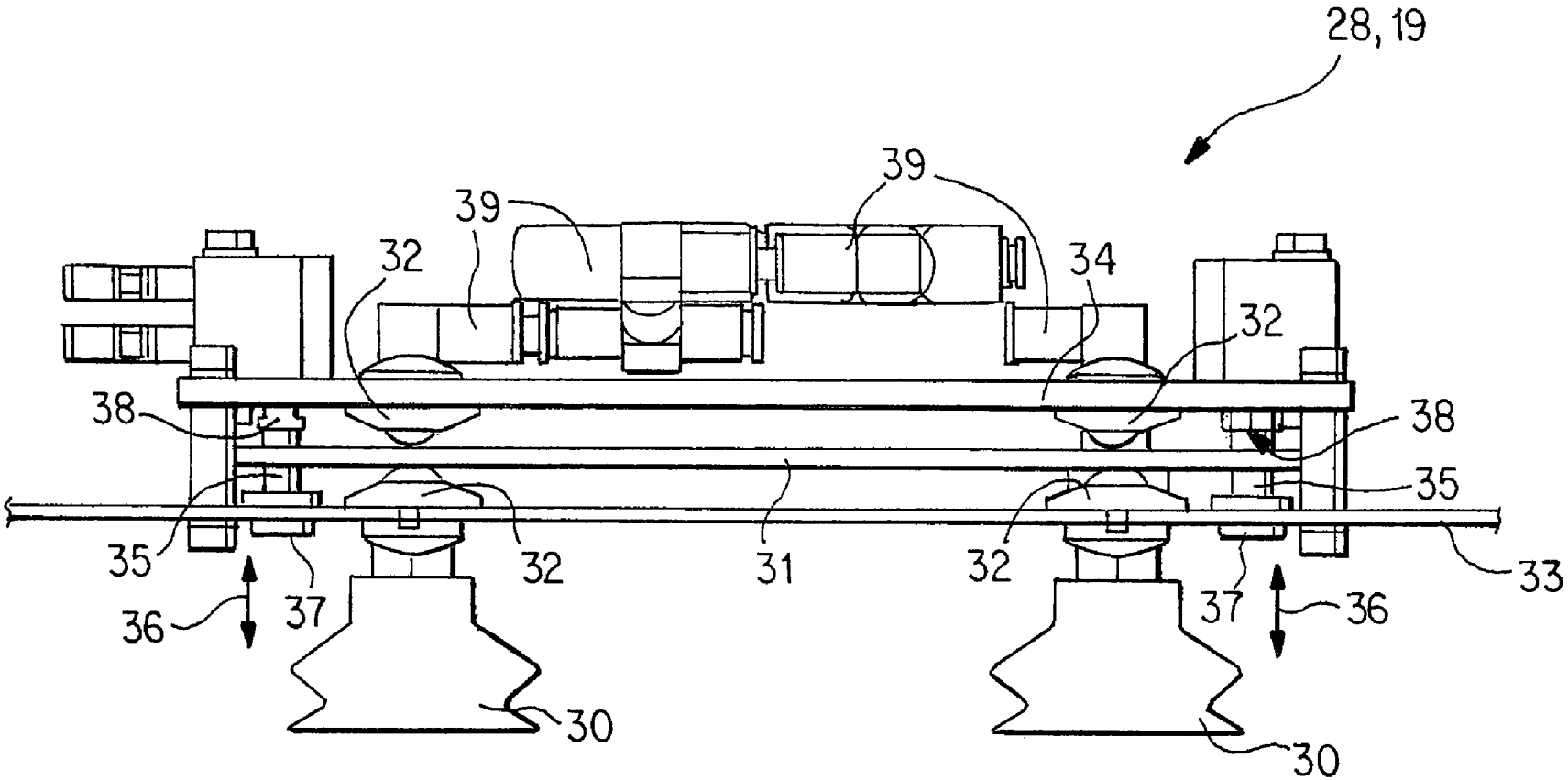
FIG. 5 is a detail of the handling device in FIGS. 2 through 4.

FIG. 5 shows a section of the handling element 28 of the manipulator head 19 that is embodied as a suction device in the region of two suction nozzles 30. The two suction nozzles 30 are fastened to a support element 31 embodied as a plate, whereby the support element 31 and thus the two suction nozzles 30 are positioned in a floating manner in the handling element 28. As a result, FIG. 5 shows a total of four ball rollers 32, whereby two ball rollers 32 cooperate with an upper side of the support element 31 and two ball rollers 32 cooperate with a lower side of the support element 31.

The ball rollers 32 cooperating with the lower side of the support element 31 are fastened to a cross bar 33 of the handling element 28, and the ball rollers 32 cooperating with the upper side of the support element 31 are fastened to a support plate 34, on the other hand.

Cooperating with the ball rollers 32, are fixing bolts 35 of a fixation device, which are axially displaceable in the direction of the arrow 36. The fixing bolts 35 penetrate the support element 31 as well as the cross bar 33 and are fed into the guide elements 37 allocated to the cross bar 33. In the representation in FIG. 5, the fixing bolts 35 release the floating positioning of the two suction nozzles 30 so that, as a result, the support element 31 can be tilted to a certain extent together with the suction nozzles 30. To fix the support element 31 and therefore to block the floating positioning of the suction nozzles 30, the fixing bolts 35 are moved downward with respect to the position depicted in FIG. 5 so that phases 38 allocated to the fixing bolts 35 engage in corresponding phases of the support element 31. Then, when the printing plates 16 are supposed to be grasped and transported, the fixing bolts 35 block the floating positioning of the support element 31 and thus the suction nozzles 30. If, on the other hand, the printing plates are supposed to be transferred to a plate cylinder 13 and threaded into a lockup slot of the plate cylinder, then, on the other hand, the fixing bolts 35 release the floating positioning of the support element 31 and thus the suction nozzles 30.

To aid in threading the printing plates into the lockup slot of a plate cylinder, a vibration device (not shown) can be allocated to the entire handling element 28 in order to make the printing plates vibrate.

Instead of individual suction nozzles, the handling element 28 that is embodied as a suction device can also be designed as a continuous suction bar. A vacuum in the region of the suction nozzles is made available by compressed air elements 39.

LIST OF REFERENCE NUMERALS

10 Handling device
11 Printing unit
12 Printing couple
13 Plate cylinder
14 Transfer cylinder
15 Satellite cylinder
16 Printing plate
17 Web guide wall
18 Manipulator arm
19 Manipulator head
20 Segment
21 Segment
22 Segment
23 Swivel axis
24 Swivel axis
25 Swivel axis
26 Swivel axis
27 Drive
28 Handling element
29 Brace
30 Suction nozzle
31 Support element
32 Ball rollers
33 Cross bar
34 Support plate
35 Fixing bolt
36 Direction of Movement
37 Guide element
38 Phase
39 Compressed air element The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A handling device of a printing press for handling a printing plate, comprising:

a manipulator arm, including:

a first segment including a first set of parallel braces;

a second segment including a second set of parallel braces; and a third segment including a third set of parallel braces;

a first swivel axis coupled to adjacent ends of the first set of parallel braces and the second set of parallel braces;

a second swivel axis coupled to adjacent ends of the second set of parallel braces and the third set of parallel braces;

a first drive coupled to the first swivel axis, wherein the first swivel axis is moveable by the first drive;

a second drive coupled to the second swivel axis, wherein the second swivel axis is moveable by the second drive;

wherein the first segment and the second segment are moveable relative to each other by movement of the first swivel axis;

and wherein the second segment and the third segment are moveable relative to each other by movement of the second swivel axis; and a manipulator head coupled to the third segment, wherein the manipulator head includes a handling element engageable with the printing plate.

2. The handling device according to claim 1, wherein the handling element is embodied as a suction device including suction nozzles for handling printing plates, wherein there are two suction nozzles for each printing plate handled, the suction nozzles being positioned in a floating manner on a common support element in such a way that, when grasping and transporting a printing plate, a fixing device blocks the floating positioning of the respective suction nozzles and, when delivering a printing plate, the fixing device releases the floating positioning of the respective suction nozzles.

3. The handling device according to claim 1, wherein an end of the first segment that connects the manipulator arm to a frame and/or to a wall is stationary with respect to the frame and/or the wall.

* * * * *